US008073373B2

(12) United States Patent
Kitami

(10) Patent No.: US 8,073,373 B2
(45) Date of Patent: Dec. 6, 2011

(54) IMAGE FORMING APPARATUS WITH DEVICE FOR REDUCING STAGNANT TONER BETWEEN FIXING ROLLER AND CLEANING WEB

(75) Inventor: Kenji Kitami, Kasihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 566 days.

(21) Appl. No.: 12/194,666

(22) Filed: Aug. 20, 2008

(65) Prior Publication Data

US 2009/0067865 A1 Mar. 12, 2009

(30) Foreign Application Priority Data

Sep. 7, 2007 (JP) ..... 2007-232962

(51) Int. Cl.
*G03G 15/20* (2006.01)

(52) U.S. Cl. ..... 399/327; 399/67; 399/320; 399/326

(58) Field of Classification Search ..... 399/67, 399/320, 327, 329
See application file for complete search history.

(56) References Cited

U.S. PATENT DOCUMENTS

| | | | | |
|---|---|---|---|---|
| 7,565,101 | B2 * | 7/2009 | Yamanaka et al. | 399/323 |
| 7,634,210 | B2 * | 12/2009 | Soma et al. | 399/71 |
| 7,783,239 | B2 * | 8/2010 | Yamanaka et al. | 399/327 |
| 2003/0002894 | A1 * | 1/2003 | Satoh | 399/324 |
| 2003/0210934 | A1 * | 11/2003 | Matsumoto | 399/324 |
| 2007/0019979 | A1 * | 1/2007 | Fujii et al. | 399/67 |
| 2007/0122168 | A1 * | 5/2007 | Tanaka et al. | 399/27 |
| 2007/0140757 | A1 * | 6/2007 | Poxon et al. | 399/327 |

FOREIGN PATENT DOCUMENTS

| | | | |
|---|---|---|---|
| JP | 62047671 A | * | 3/1987 |
| JP | 2-284184 A | | 11/1990 |
| JP | 04014082 A | * | 1/1992 |
| JP | 4-134476 A | | 5/1992 |
| JP | 05107976 A | * | 4/1993 |
| JP | 8-69200 A | | 3/1996 |
| JP | 2000-214716 A | | 8/2000 |
| JP | 2000214716 A | * | 8/2000 |
| JP | 2003-167465 A | | 6/2003 |
| JP | 2003167465 A | * | 6/2003 |
| JP | 2008304714 A | * | 12/2008 |

* cited by examiner

*Primary Examiner* — David Gray
*Assistant Examiner* — Francis Gray
(74) *Attorney, Agent, or Firm* — Birch, Stewart, Kolasch & Birch, LLP

(57) ABSTRACT

An image forming apparatus includes: a pattern determination information calculator for calculating printing pattern determination information on an original; a pressure changer for changing the pressure of a pressing member of a cleaning device; and a controller for varying the pressing force of the pressing member by controlling the pressure changer in accordance with the printing pattern determination information calculated by the pattern determination information calculator. The controller controls the contact pressure driver of the pressing roller so as to weaken the pressing force when that controller determines that printing paper printed with high density patterns or high coverage patterns will be passed through.

6 Claims, 6 Drawing Sheets

IMAGE FORMING APPARATUS WITH DEVICE FOR REDUCING STAGNANT TONER BETWEEN FIXING ROLLER AND CLEANING WEB

This Nonprovisional application claims priority under 35 U.S.C. §119(a) on Patent Application No. 2007-232962 filed in Japan on 7 Sep. 2007, the entire contents of which are hereby incorporated by reference.

BACKGROUND OF THE INVENTION (1) Field of the Invention

The present invention relates to an image forming apparatus such as a copier, printer or the like including a thermal fixing device in which the surface of the fixing roller is cleaned by a cleaning web.

(2) Description of the Related Art

Conventionally, there has been a known thermal fixing device used in image forming apparatuses such as copiers etc., which include a cleaning web type-cleaning device as a mechanism for reducing residual toner left over on the fixing roller surface.

As this cleaning device, a cleaning device that continues rotating a cleaning web (cleaning means) for a fixed time after the end of printing and then stops it in order to remove residual toner on the fixing roller surface, has been proposed (Japanese Patent Application Laid-open H2-284184).

However, the fixing device with the above cleaning device entails the problem that when print media (printing sheets) are continuously passed through the fixing device, a large amount of offset toner stagnates around the contact area where the cleaning web and the fixing roller contact each other (see FIG. 2 described below) because of lowering of the surface temperature of the fixing roller. As a result, the thus stagnant toner is fully heated and fused, and the fused toner weaves through the contact area to thereby dirty the paper.

To deal with this, in order to prevent stagnant toner 153 from weaving through the contact area even when a large amount of offset toner has stagnated around the above contact area, a cleaning device having a pressure changing means for varying the pressing force of the pressing member (pressing roller 136; see FIG. 1 below) that presses the cleaning web against the fixing roller has been proposed (patent document 2: Japanese Patent Application Laid-open 2003-167465).

Now, the basic configuration and operation of a thermal fixing device equipped with a conventional cleaning device will be briefly described.

FIG. 1 is an illustrative view schematically showing the configuration of a cleaning type-thermal fixing device.

As shown in FIG. 1, a thermal fixing device 121 includes a pair of a fixing roller 123 and a pressure roller 124.

Fixing roller 123 is composed of a core member formed of metal such as aluminum or the like having an elastic layer on the outer peripheral surface thereof, a pair of halogen lamp heaters, namely main and sub heaters 128 and 129 arranged inside the core member. A temperature detector 130 of a non-contact type thermistor is arranged around fixing roller 123 so that the surface temperature can be controlled within the range of 160 to 200 deg. .C by main heater 128 and sub heater 129.

Arranged above fixing roller 123 is a web-type cleaning device (cleaning unit) 120 for wiping off the residual toner adhering on the outer peripheral surface. Cleaning unit 120 is essentially comprised of a web sheet delivering roller 132, a tension roller 134 for applying a predetermined tension on a web sheet 133 delivered from web sheet delivering roller 132, a pressing roller 136 for pressing web sheet 133 against the outer peripheral surface of fixing roller 123 and a take-up roller 137 for taking up the used web sheet.

An unillustrated pressure changing mechanism (pressure changing means) is provided for the roller shaft of the pressing roller 136 so as to move and adjust the roller shaft of pressing roller 136 in the directions of a bidirectional arrow A, whereby the web nip width, designated at 139, formed between the fixing roller 123 surface and pressing roller 136 is varied to thereby change the pressing force against fixing roller 123. For example, when pressing roller 136 is moved in the upward direction of bidirectional arrow A to the position indicated by the dashed line, the pressing force lowers so that web nip width 139 becomes smaller. In contrast, when the roller is moved in the downward direction of bidirectional arrow A to the position indicated by the solid line, the pressing force increases so that web nip width 139 becomes greater.

Here, as the pressure changing means, it is possible to control the pressing force by using, for example a rotatable cam mechanism or the like. In addition, this cleaning unit 120 is a periodical replacement part to be replaced in a predetermined replacement cycle.

Similarly to fixing roller 123, pressure roller 124 also is composed of a metal core member having an elastic layer on the outer peripheral surface thereof, a halogen lamp heater, namely pressure roller heater 138 arranged in the core member.

Separation claws 135A and 135B are arranged to abut on the outer peripheral surfaces of fixing roller 123 and pressure roller 124, respectively so as to prevent the print paper, after the heating process, from winding around fixing roller 123 or pressure roller 124.

According to thermal fixing device 121 that functions as described above, as shown in FIG. 2, even when printing sheets are continuously passed through and hence the amount of offset toner becomes greater due to lowering of the surface temperature of fixing roller 123, it is possible to prevent stagnant toner 153 around the contact area from passing therethrough by enhancing the contact pressure of pressing roller 136 against fixing roller 123. As a result, it is possible to prevent leakage toner 150 and 151 from dirtying fixing roller 123 and printing paper by adherence of toner thereto.

Here, when printing sheets printed with high density patterns or high coverage patterns are passed through the fixing device, toner is liable to stagnate on the upstream side of the contact area between fixing roller 123 and cleaning web 133. In this situation, once printing is ceased, the surface temperature of fixing roller 123 lowers and the large amount of residual toner solidifies on the fixing roller 123 surface and adheres thereto.

To deal with this, in the conventional method of controlling the contact pressure of pressing roller 136 against fixing roller 123 based on the information as to lowering of the surface temperature of fixing roller 123 only, it is possible to reduce the amount of toner remaining around the contact area by further enhancing the contact pressure of pressing roller 136 against fixing roller 123 from the normal contact pressure of a predetermined level to a higher level, or increasing the rotational rate of take-up roller 137 to increase the winding length of web sheet 133.

However, in both of these cases, the friction between pressing roller 136 and fixing roller 123 is increased, so that there occurs the problem that the fixing roller 123 surface is worn out excessively, needing frequent maintenance work of the entire cleaning device and hence needing high maintenance cost and others.

SUMMARY OF THE INVENTION

In consideration of what has been discussed above, it is therefore an object of the present invention to provide an image forming apparatus including a thermal fixing device equipped with a cleaning mechanism that prevents noticeable dirtying of printing paper by reducing the stagnant toner arising when printing sheets printed with high density patterns or high coverage patterns are passed through the fixing device, is improved in reliability and enables easy maintenance and management.

In order to achieve the above object, the present invention is configured as follows:

An image forming apparatus according to the present invention includes: a thermal fixing device including a fixing roller and a cleaning device for cleaning the fixing roller surface by bringing a cleaning web into pressure contact with the fixing roller surface by means of a pressing member; a pattern determination information calculator for calculating printing pattern determination information on image data; a pressure changer for changing the pressure of the pressing member of the cleaning device; and a controller for varying the pressing force of the pressing member by controlling the pressure changer in accordance with the printing pattern determination information calculated by the pattern determination information calculator.

The image forming apparatus of the present invention may be configured such that when the value of the pattern determination information calculated by the pattern determination information calculator is determined to be equal to or above a predetermined threshold, the controller controls the pressure changer so as to weaken the pressing force from a predetermined level of pressure.

Also, the image forming apparatus of the present invention may be configured such that when the value of the pattern determination information calculated by the pattern determination information calculator is determined to be lower than a predetermined threshold, the controller controls the pressure changer so as to enhance the pressing force from a predetermined level of pressure, and when the value is determined to be equal to or above the predetermined threshold, the controller controls the pressure changer so as to weaken the pressing force with increase of the value of the pattern determination information.

The image forming apparatus of the present invention may be further configured such that the pattern determination information is the coverage ratio, and the pattern determination information calculator calculates the coverage ratio based on the ratio of black pixels in the total pixels in the whole printable area or in a predetermined partial area of the total printable area.

Still, the image forming apparatus of the present invention may be configured such that the pattern determination information is print density, the pattern determination information calculator calculates the print density based on the ratio of black pixels in the total pixels in the total printable area or in a predetermined partial area of the total printable area.

Finally, the image forming apparatus of the present invention may be configured such that the pattern determination information calculated by the pattern determination information calculator is the coverage ratio, and the controller controls the pressure changer so as to weaken the pressing force when the coverage ratio is 80% or greater.

In the image forming apparatus having the above configuration, it is possible to prevent toner from stagnating on the upstream side of the contact area between the fixing roller and the cleaning web by weakening the pressing force of the cleaning web against the fixing roller when printing sheets printed with high density patterns or high coverage patterns are passed through.

According to the thus constructed image forming apparatus of the present invention, even when printing sheets printed with high density patterns or high coverage patterns, which would cause a large amount of offset toner, are passed through, it is possible to prevent a large amount of toner from stagnating on the upstream side of the contact area between the fixing roller and the cleaning web by weakening the contact pressure of the cleaning web against the fixing roller, hence it is possible to prevent noticeable dirtying of the printing paper as well as to reduce the frequency of maintenance and management work.

DETAILED DESCRIPTION OF THE INVENTION

The embodiment of the present invention will hereinafter be described in detail with reference to the accompanying drawings.

Figure 1:
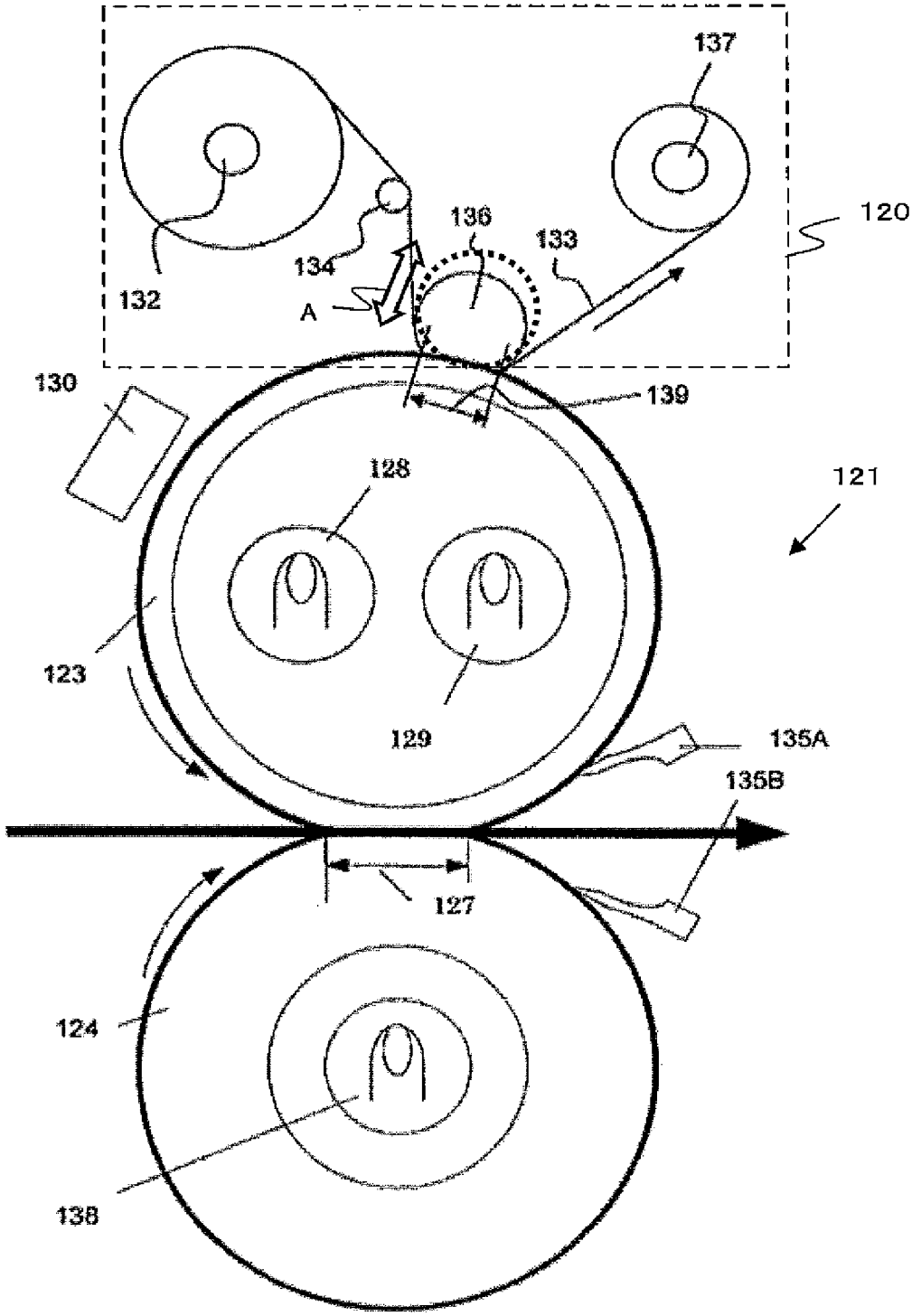
FIG.1 Prior Art
FIG. 1 is an illustrative view schematically showing a configuration of a thermal fixing device with a cleaning mechanism.
Figure 2:
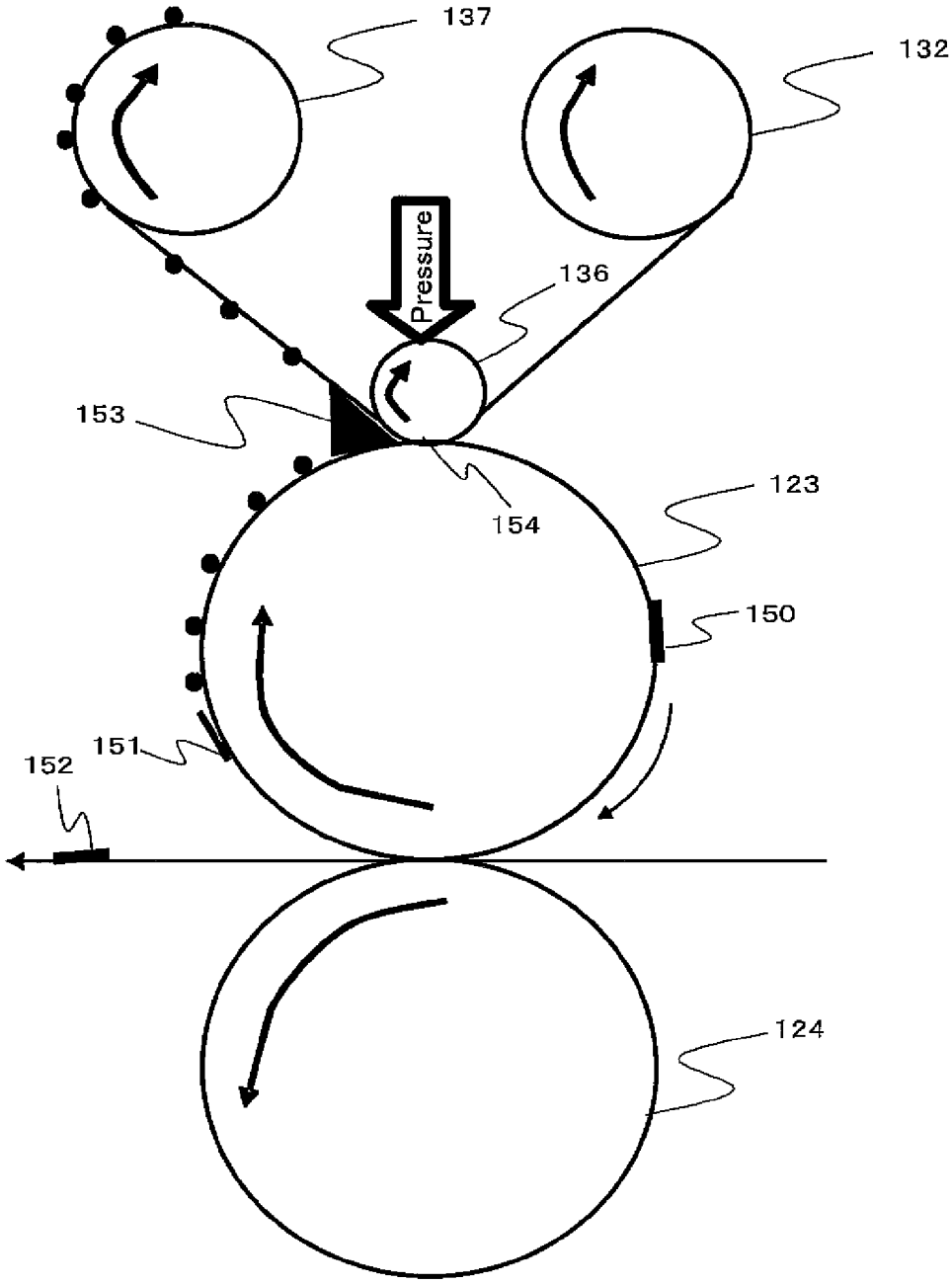
FIG.2 Prior Art
FIG. 2 is an illustrative view schematically showing how a cleaning mechanism is operated to control pressure contact.

FIGS. 3 to 6 show one example of an embodiment of an image forming apparatus according to the present invention. The components allotted with the same reference numerals in the drawings should represent identical members, inclusive of FIGS. 1 and 2 which illustrate a conventional image forming apparatus.

<Description of the Overall Configuration and Operation of the Image Forming Apparatus>

Figure 3:
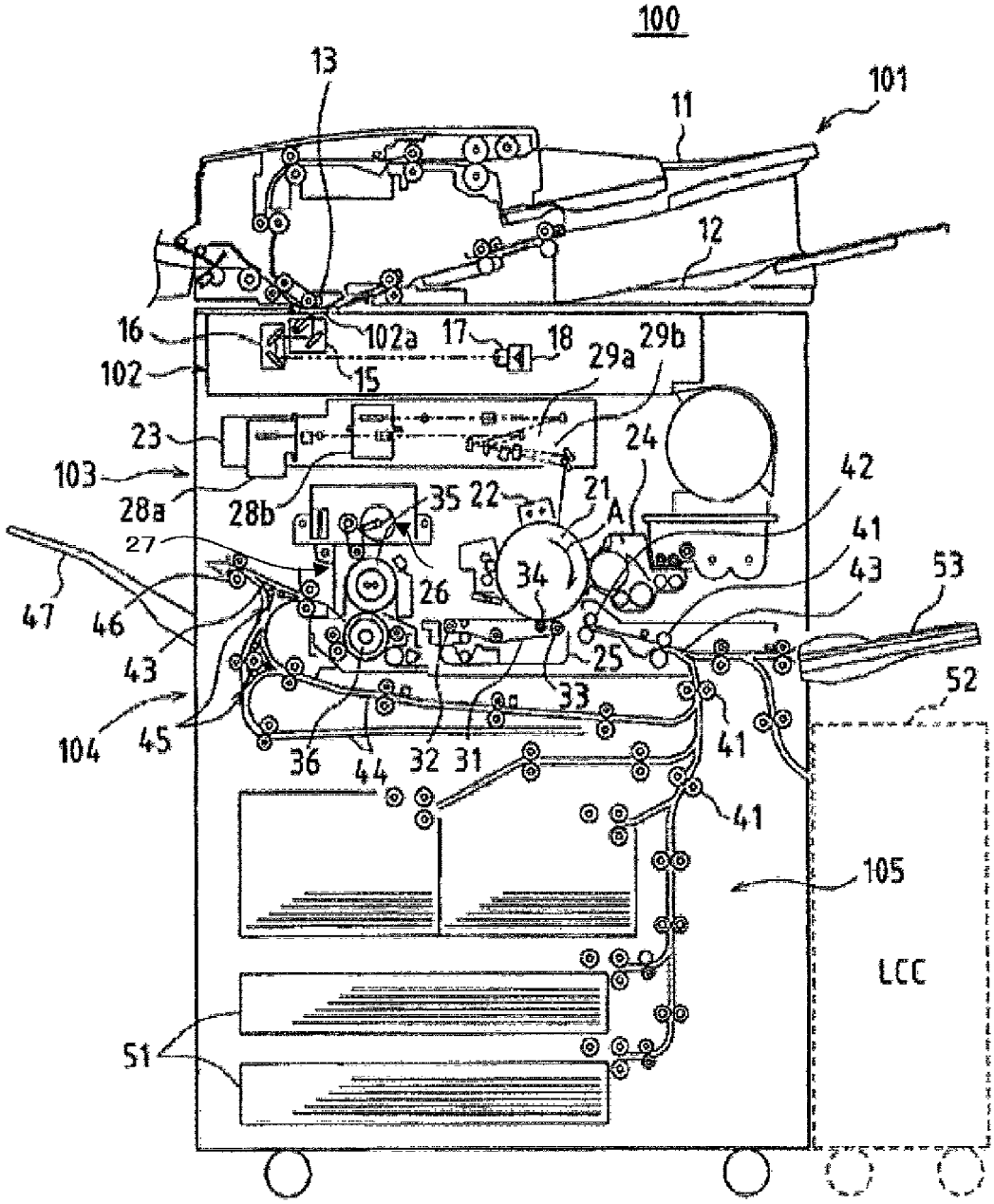
FIG. 3 is a schematic configurational view showing an overall configuration of one embodiment of an image forming apparatus according to the present invention.

FIG. 3 is a schematic configurational view showing an overall configuration of one embodiment of an image forming apparatus of the present invention.

As shown in FIG. 3, an image forming apparatus 100 according to the present embodiment is to form images by an electrophotographic printing process, and includes: an image bearer (photoreceptor drum, herein) 21 of a rotational body; a charger 22 for electrifying the photoreceptor drum 21 surface; a light-exposure device (optical writing unit, herein) 23 for forming an electrostatic latent image on photoreceptor drum 21; a developing unit 24 for developing the electrostatic latent image with a developer to form a toner image on photoreceptor drum 21; a transfer device (transfer unit, herein) 25 for transferring the toner image on photoreceptor drum 21 to a printing sheet (e.g., sheet-like recording media such as recording paper, OHP sheets, etc.); a thermal fixing device (thermal fixing unit, herein) 27 for heating and fixing the transferred image on the printing sheet to the printing sheet; a cleaning device (cleaning unit, herein) 26 for removing residual toner that has not been transferred to by transfer device 25 and has left over on the photoreceptor drum 21 surface; and a charge erasing device (not shown) for removing residual electricity remaining on the photoreceptor drum 21 surface.

Here, image forming apparatus 100 acquires image data read from originals or acquires image data received from without to form monochrome images represented by the image data on printing sheets. The image forming apparatus is roughly constructed of a document feeder (ADF) 101, an image reader 102, a printing portion 103, sheet conveyor 104 and paper feeder 105.

In particular, of the above constituents, printing portion 103 is for recording original images represented by image data to printed sheets, and includes aforementioned components, photoreceptor drum 21, charger 22, optical writing unit 23, developing unit 24, transfer unit 25, cleaning unit 26, thermal fixing unit 27 and the like.

Sheet conveyor 104 includes plural pairs of conveying rollers 41 for conveying sheets, a pair of registration rollers 42, a paper feed path 43, an inversion/conveyance path 44, a plurality of branch claws 45, a pair of paper discharge rollers 46 and the like.

Next, the practical operation of image forming apparatus 100 of the present embodiment having the above configuration will be described.

In document feeder 101, when, at least, one document is set on a document set tray 11, the documents are pulled out from document set tray 11, sheet by sheet. This document is conducted to and passed over a document reading window 102*a* of paper reader 102 and discharged to a document output tray 12.

A CIS (contact image sensor) 13 is arranged over document reading window 102*a*. This CIS 13 repeatedly reads the image on the rear side of the document raster-wise in the main scan direction while the document is passing over document reading window 102*a*, to thereby output the image data that represents the image on the rear side of the document.

Further, image reader 102 illuminates the document surface with light from the lamp of a first scan unit 15 when the document passes over document reading window 102*a* and the reflected light from the document surface is lead to an image focusing lens 17 by way of the mirrors of first and second scan units 15 and 16, so that the image on the document surface is focused by image focusing lens 17 onto the a CCD (charge coupled device) 18. CCD 18 repeatedly reads the image of the document surface in the main scan direction to thereby output image data that represents the image on the document surface.

On the other hand, when the document is placed on the platen glass on the top of image reader 102, first and second scan units 15 and 16 are moved keeping a predetermined speed relationship relative to each other while the document surface on the platen glass is illuminated by first scan unit 15, and the light reflected off the document surface is lead to image focusing lens 17 by means of first and second scan units 15 and 16 so that the image on the document surface is focused onto CCD 18 by image focusing lens 17.

The image data output from CIS 13 or CCD 18 is subjected to various kinds of image processes by an image processor 248 (not shown) and then output to printing portion 103.

While photoreceptor drum 21 rotates so that its surface moves in a predetermined direction (in the direction of arrow A in the drawing), its surface is cleaned by cleaning unit 26 and then charged uniformly by charger 22. Charger 22 may be either a corona discharge type or a roller or brush type that contacts with photoreceptor drum 21.

Optical writing unit 23 is a laser scanning unit (LSU) including two laser emitters 28*a* and 28*b* and two mirror groups 29*a* and 29*b*. This optical writing unit 23 receives image data and emits laser beams from laser emitters 28*a* and 28*b* in accordance with the image data. These laser beams are radiated on photoreceptor drum 21 by way of respective mirror groups 29*a* and 29*b* to thereby illuminate the photoreceptor drum 21 surface that has been uniformly electrified, forming an electrostatic latent image on the photoreceptor drum 21 surface.

In order to achieve a high-speed printing operation, this optical writing unit 23 employs a two-beam system including two laser emitters 28*a* and 28*b* to thereby reduce the burden entailed with the high frequency of irradiation.

Here, as the optical writing unit 23, an array of light emitting elements, e.g., an EL writing head or LED writing head may be used instead of the laser scanning unit.

Developing unit 24 supplies toner to the photoreceptor drum 21 surface to develop the electrostatic latent image into a toner image on the photoreceptor drum 21 surface. Transfer unit 25 transfers the toner image on the photoreceptor drum 21 surface to the sheet that is conveyed by sheet conveyor 104. Thermal fixing unit 27 heats and pressurizes the sheet to fix the toner image onto the sheet. Thereafter, the sheet is further conveyed by sheet conveyor 104 and discharged to a paper output tray 47. During this time, cleaning unit 26 removes and collects the toner left over on the photoreceptor drum 21 surface after development and transfer.

Here, transfer unit 25 includes a transfer belt 31, drive roller 32, driven roller 33, elastic conductive roller 34 and the like, and rotates transfer belt 31 while supporting and tensioning the belt on the aforementioned rollers 32 to 34 and other rollers. Transfer belt 31 has a predetermined resistivity (e.g., $1\times10^{9}$ to $1\times10^{13}$ Ω·cm) and conveys the sheet placed on its surface. Elastic conductive roller 34 is pressed against the photoreceptor drum 21 surface with transfer belt 31 in between, so as to press the sheet on transfer belt 31 against the photoreceptor drum 21 surface. Applied to this elastic conductive roller 34 is an electric field that has a polarity opposite to the charge of the toner image on the photoreceptor drum 21 surface. This electric field of the opposite polarity causes the toner image on the photoreceptor drum 21 surface to transfer to the sheet on transfer belt 31. For example, when the toner image bears negative (−) charge, the polarity of the electric field applied to elastic conductive roller 34 is set to be positive (+).

Thermal fixing unit 27 includes a pair of rollers as rotational bodies (fixing roller 35 and pressure roller 36 herein). A heater is arranged inside fixing roller 35 in order to set the fixing roller 35 surface at a predetermined temperature (fixing temperature: approximately 160 to 200 deg. C.). A pair of unillustrated pressing members are arranged at both ends of pressure roller 36 so that pressure roller 36 comes into pressing contact with fixing roller 35 with a predetermined pressure. As the sheet reaches the pressure contact portion (called as the heating nip portion) between fixing roller 35 and pressure roller 36, the unheated toner image on the sheet is thermally fused and pressurized while it is being conveyed by the rollers 35 and 36, so that the toner image is heated over the sheet.

Conveyance path 43 receives the sheet delivered from paper feeder 105 and conveys the sheet until its leading end reaches registration rollers 42. Since registration rollers 42 are temporarily stopped at that timing, the leading end of the sheet reaches and abuts registration rollers 42 so that the sheet bends. The resiliency of this bent sheet makes the front edge of the sheet substantially parallel to registration rollers 42. Thereafter, registration rollers 42 start rotating so as to convey the sheet to transfer unit 25 of printing portion 103 and then the sheet is further conveyed by paper discharge rollers 46 to paper output tray 47.

Stoppage and rotation of registration rollers 42 can be controlled by switching on or off a clutch between registration roller 42 and its drive shaft or by turning on or off a motor as the drive source of registration rollers 42.

When another image is recorded on the rear side of the sheet, a plurality of branch claws 45 are turned to switch the paper path from conveyance path 43 to inversion/conveyance path 44 so that the sheet is turned upside down and returned through inversion/conveyance path 44 to registration rollers 42 in conveyance path 43. Thus, another image is recorded on the rear side of the sheet.

Arranged at the necessary positions along conveyance path 43 and inversion/conveyance path 44 are several sensors for detecting the sheet position etc., and based on the position of the sheet detected at each sensor, the drives of the conveying rollers and registration rollers are controlled so as to convey and position the sheet.

Paper feeder 105 includes a plurality of paper feed trays 51. Each paper feed tray 51 is a tray for holding a stack of recording sheets and is arranged under image forming apparatus 100. Also, each paper feed tray 51 includes a pickup roller or the like for pulling out sheet, one by one so as to deliver the picked up sheet to conveyance path 43 of sheet conveyor 104.

In image forming apparatus 100 of the present embodiment, in order to achieve high speed printing, the distance between sheets, that are conveyed, one from another is specified to be short (for example, a distance of about 50 mm).

Since image forming apparatus 100 of the present embodiment is aimed at high speed printing processing, each paper feed tray 51 has a capacity capable of stacking 500 to 1500 sheets of sheet of a regular size.

Arranged on the flank of image forming apparatus 100 are a large capacity paper cassette (LCC) 52 for accommodating large amounts of a plurality of types of sheets and a manual feed tray 53 for primarily supplying sheets of irregular sizes.

Paper output tray 47 is arranged on the side opposite from manual feed tray 53. It is also possible to optionally arrange an output paper finisher (for stapling, punching, etc.) or a multi-bin paper output tray, in place of the paper output tray 47.

<Description of the Operation of Controlling the Contact Pressure of the Pressure Roller in Cleaning Unit 26>

First, before describing the operation of controlling the contact pressure of pressing roller 136, the operational concept for winding control of take-up roller 137 will be described with reference to FIG. 4.

Figure 4:
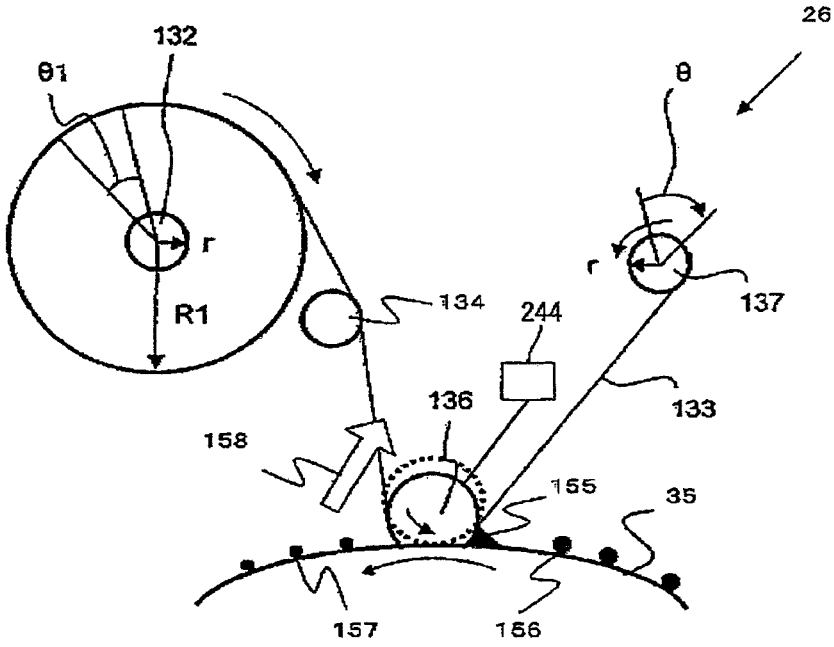
FIG. 4 is an illustrative view schematically showing a cleaning unit.

FIG. 4 is an illustrative view schematically showing cleaning unit 26.

Cleaning unit 26 includes take-up roller 137 for winding web sheet 133 and delivering roller 132 for feeding web sheet 133, the shafts of these rollers having a radius of r.

At the initial stage when fresh cleaning unit 26 is just set, delivering roller 132 is rolled with unused web sheet 133. In this condition, the web sheet 133 is delivered from the outmost position of the roll having a radius of R1. On the other hand, one end of web sheet 133 is fixed to take-up roller 137, but the radius when web sheet 133 is taken up is substantially equal to the radius r of the shaft. Web sheet 133 is assumed to have a uniform thickness of t.

Under these conditions, if a length L (≧Ln) of the web sheet is assumed to be taken up by take-up roller 137 for one winding operation, or to be delivered from delivering roller 132, the rotational angle θ of take-up roller 137 being rotated in the first winding operation (n=1) at the initial stage, for taking up the wound length L is given as the following equation:

$$\theta=360°\times L/(2\pi r).$$

On the other hand, delivering roller 132 rotates following the rotation of take-up roller 137, so that its peripheral point moves in the same distance (delivering length L) as the distance (winding length L) of the peripheral movement of take-up roller 37. Therefore, the rotational angle θ1 is given as the following equation:

$$\theta 1=360°\times L/(2\pi R1).$$

When the length L of web sheet 33 being delivered for one winding operation is controlled to be constant for every predetermined period, the rotational angle θ of take-up roller 137 and the rotational angle θ1 of delivering roller 132 are controlled to be smaller and greater, respectively, as the number of times of the winding operations increases because the radius r of the shaft and the radius R1 of the shaft become greater and smaller.

It should be noted that it is possible to reduce a greater amount of stagnant toner 155 residing on the upstream side of the contact area between fixing roller 123 and cleaning web 133 by increasing the winding distance L.

Next, description will be made on the operation of controlling the contact pressure of pressing roller 136 as the main feature of image forming apparatus 100 of the present invention.

First, the configuration and basic operation of a controller 240 for performing overall control of thermal fixing device 27 will be described.

Figure 5:
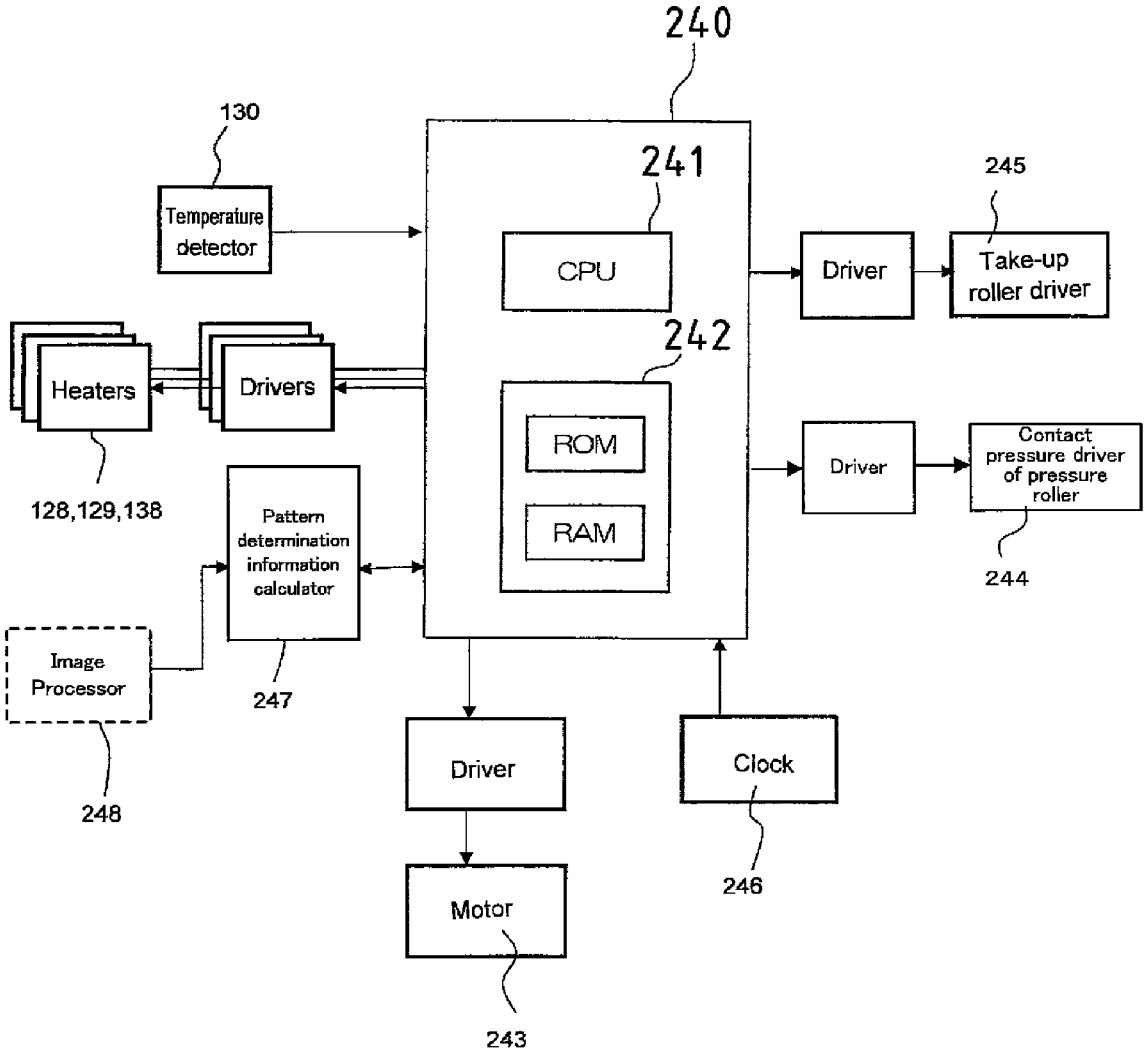
FIG. 5 is a block diagram showing a thermal fixing device including a controller that performs overall control.

FIG. 5 is a block diagram showing thermal fixing device 27 including a controller that performs overall control.

As shown in FIG. 5, controller 240 includes a CPU (central processing unit) 241 and a storage 242. Storage 242 stores various control programs and necessary functions, including ROM (read only memory) and RAM (random access memory).

Controller 240 performs heating and fixing control inclusive of the winding control of take-up roller 137 by CPU 241 which reads out various control programs from storage 242 and executes the read control programs.

Here, controller 240 may be configured to control not only thermal fixing device 27 but also the entire operation of image forming apparatus 100. In this case, controller 240 performs control also including the printing process control of image forming apparatus 100.

On the other hand, when controller 240 performs control of thermal fixing device 27 only, a communicator for performing communication with the controller that performs the entire control of image forming apparatus 100 is provided so as to control thermal fixing device 27 by way of this communicator.

In FIG. 5, a motor 243 is the drive source for rotationally driving fixing roller 35 and pressure roller 36, and its rotational drive is controlled by way of a driver.

Temperature detector 130, heaters 128, 129 and 138 for controlling the surface temperatures of the fixing roller and pressure roller are each connected to controller 240 via respective drivers. Controller 240 performs control to turn on or off the electric power to the heaters based on the temperature information from temperature detector 130. Here, control of switching on or off the power to heaters 128, 129 and 138 can be made independently from each other.

A take-up roller driver 245 is a motor for driving take-up roller 137 and is controlled so as to deliver a predetermined length of web sheet 133 by measuring the drive time of take-up roller driver 245 using a clock 246.

Next, the concept of the operation of contact pressure control of pressing roller 136 in cleaning unit 26 will be described.

Controller 240 determines, in advance, whether the original to be printed is one with a high density pattern or one with a high coverage pattern. If the original is to be printed in a high density or with a high coverage ratio, the controller makes control so as to move pressing roller 136 in the direction of an arrow 158 in FIG. 4, in order to weaken the contact pressure of pressing roller 136 against fixing roller 35.

With this control, it is possible to flow out leakage toner 157 through the nip portion between fixing roller 35 and pressing roller 136 in such a degree that will not affect printing, hence it is possible to reduce, in advance, stagnant toner 155 that would pool in a large amount on the upstream side of the contact area between fixing roller 35 and cleaning web 133.

When the original is not one having a high density pattern or one having high coverage pattern, the contact pressure of pressing roller 136 against fixing roller 35 is controlled to be restored (made strong).

Next, description will be made on the specific means and operation of controller 240 for determining whether the original to be printed is one having a high density pattern or one of a high coverage ratio.

First, a pattern determination information calculator 247 which calculates print pattern determination information that indicates whether the original to be printed is one having a high density pattern or one having a high print coverage ratio, receives the processed image data of the original to be printed, from image processor 248 (included in image reader 102) for executing image processing such as filtering and the like on the image data output from the aforementioned CIS 13 or CCD 18, and calculates print pattern determining information for determining whether the original to be printed is one having a high density pattern or one having a high print coverage ratio. Examples of this print pattern determination information include the print coverage ratio or density, obtained from the ratio of the black pixels to be printed to the total printable pixels in the whole page or in a predetermined area in the page.

Controller 240 compares the print coverage ratio or density calculated as above to a predetermined threshold Th. If the calculated value is threshold Th or above, the controller determines that the original to be printed is one having a high density pattern or one having a high print coverage ratio, and controls a contact pressure driver 244 (pressure changer) via a driver to weaken the contact pressure. Here, the specific numeral of the threshold of the print coverage ratio may be 80%, for example.

Though in the present embodiment, pattern determination information calculator 247 is provided outside controller 240, it may be provided inside controller 240, so that CPU 241 will calculate the print pattern determination information.

Now, the control sequence of contact pressure driver 244 of pressing roller 136 will be described in accordance with the flow chart shown in FIG. 6.

Figure 6:
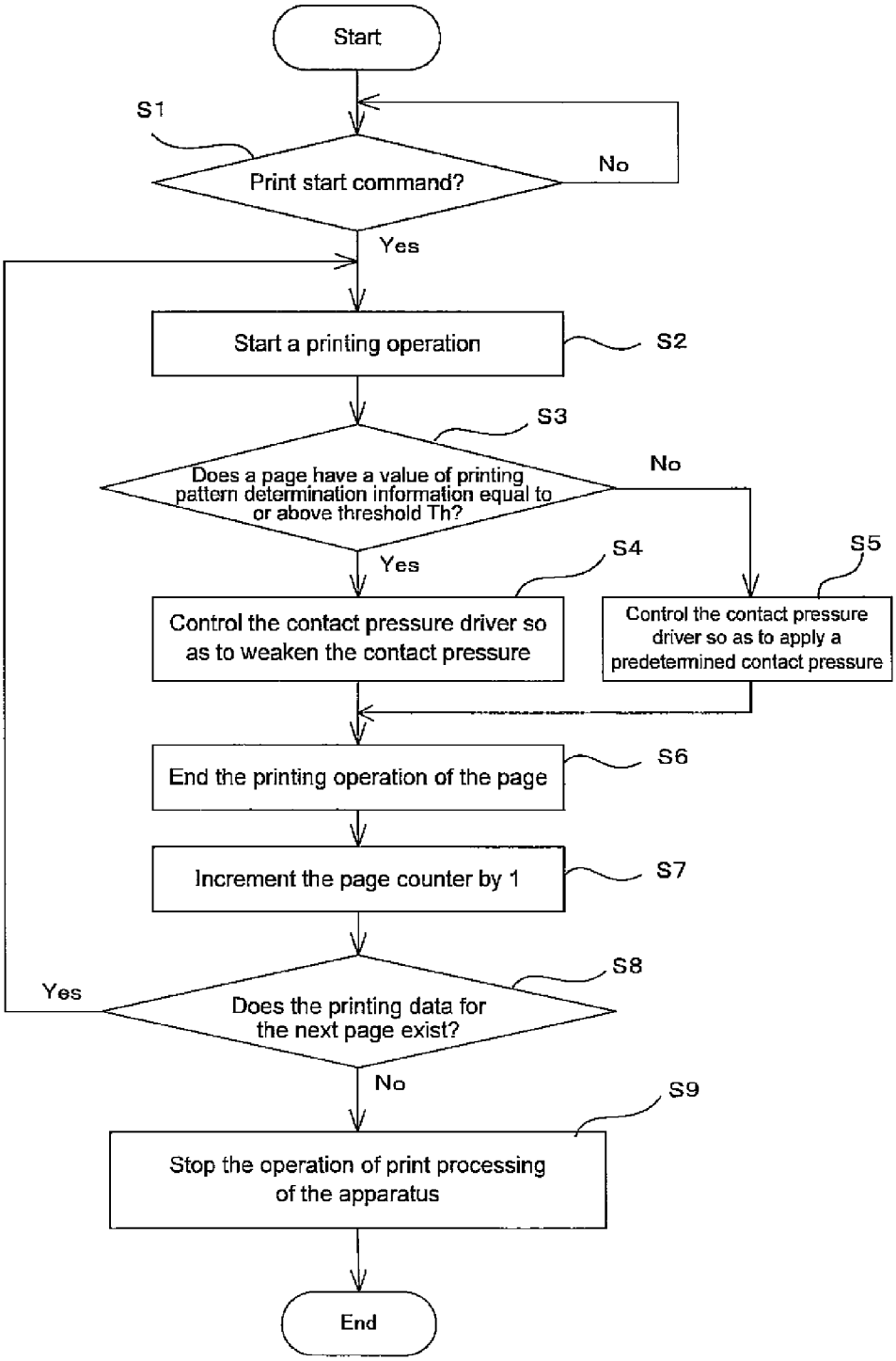
FIG. 6 is a flow chart showing how the contact pressure of a pressure roller in a cleaning unit is controlled.

FIG. 6 is a flow chart showing how the contact pressure of pressing roller 136 in cleaning unit 26 is controlled.

Here, the flow shown in FIG. 6 will be described on assumption that controller 240 is the controller for controlling the whole of image forming apparatus 100.

Controller 240 determines whether the copy start key in the control portion (not shown) of image forming apparatus 100 is pressed or whether a start command for a printing operation is given (Step S1). If the controller determines that the start command has been given (Step S1; Yes), it regards this as a print start command and starts a printing operation (Step S2) and the operation goes into the process at Step S2. If it is determined that no start command is given (Step S1; No), the operation goes back to Step S1.

Next, it is determined whether the value of the printing pattern determination information calculated by pattern determination information calculator 247 is equal to or above threshold Th (Step S3). If it is determined that the value of the printing pattern determination information is equal to above threshold Th (Step S3; Yes), the controller controls contact pressure driver 244 of pressing roller 136 to weaken the contact pressure (Step S4). On the other hand, if it is determined that the value of the printing pattern determination information is lower than threshold Th (Step S3; No), the controller controls contact pressure driver 244 so as to apply a predetermined contact pressure (Step S5) and the operation goes to the process at Step S6.

Here, in the process at Step S4, if the contact pressure was weakened in the previous operation, the operation may be controlled so that the current contact pressure is maintained or that the contact pressure is further weakened. Also, in the process at Step S5, the operation may be controlled so that the current contact pressure is maintained or that the contact pressure is further strengthened.

In the process at Step S6, the printing operation for one page of printing is ended, and the page counter is incremented by 1 (Step S7).

Next, the controller determines whether there is data for the next page (Step S8). If there is (Step S8; Yes), the operation goes back to Step S2. If it is determined that no data for next page exists (Step S8; No), the controller stops the operation of print processing of the image forming apparatus (Step S9) and ends the current operation.

As described heretofore, according to the present invention, the contact pressure of the cleaning web against the fixing roller is weakened when a printing sheet printed with a high density pattern or a high coverage pattern is passed through. As a result, it is possible to prevent stagnation of toner on the upstream side of the contact area between the fixing roller and the cleaning web and hence realize easy maintenance and management.

The image forming apparatus of the present invention should not be limited to the above embodiment, but it is apparent that various changes and modifications can be made therein without departing from the spirit and scope of the invention.

What is claimed is:

1. An image forming apparatus comprising:

a thermal fixing device including a fixing roller and a cleaning device for cleaning the fixing roller surface by bringing a cleaning web into pressure contact with the fixing roller surface by means of a pressing member;

a pattern determination information calculator for calculating print pattern determination information that indicates whether image data to be printed includes a high density pattern or a high print coverage ratio;

a pressure changer for changing the pressure of the pressing member of the cleaning device; and a controller for varying the pressing force of the pressing member by controlling the pressure changer in accordance with the printing pattern determination information calculated by the pattern determination information calculator, wherein when the value of the pattern determination information calculated by the pattern determination information calculator is determined to be equal to or above a predetermined threshold, the controller controls the pressure changer so as to weaken the pressing force from a predetermined level of pressure.

2. The image forming apparatus according to claim 1, wherein when the value of the pattern determination information calculated by the pattern determination information calculator is determined to be lower than a predetermined threshold, the controller controls the pressure changer so as to enhance the pressing force from a predetermined level of pressure, and when the value is determined to be equal to or above the predetermined threshold, the controller controls the pressure changer so as to weaken the pressing force with increase of the value of the pattern determination information.

3. The image forming apparatus according to claim 1, wherein the pattern determination information is the coverage ratio, and the pattern determination information calculator calculates the coverage ratio based on the ratio of black pixels in the total pixels in the whole printable area or in a predetermined partial area of the total printable area.

4. The image forming apparatus according to claim 1, wherein the pattern determination information is print density, the pattern determination information calculator calculates the print density based on the ratio of black pixels in the total pixels in the total printable area or in a predetermined partial area of the total printable area.

5. The image forming apparatus according to claim 1, wherein the pattern determination information calculated by the pattern determination information calculator is the coverage ratio, and the controller controls the pressure changer so as to weaken the pressing force when the coverage ratio is 80% or greater.

6. An image forming apparatus comprising:

a thermal fixing device including a fixing roller and a cleaning device for cleaning the fixing roller surface by bringing a cleaning web into pressure contact with the fixing roller surface by means of a pressing member;

a pattern determination information calculator for calculating print pattern determination information that indicates whether image data to be printed includes a high density pattern or a high print coverage ratio;

a pressure changer for changing the pressure of the pressing member of the cleaning device; and a controller for varying the pressing force of the pressing member by controlling the pressure changer in accordance with the printing pattern determination information calculated by the pattern determination information calculator, wherein the pattern determination information calculated by the pattern determination information calculator is the coverage ratio, and the controller controls the pressure changer so as to weaken the pressing force when the coverage ratio is 80% or greater.

* * * * *